United States Patent [19]

Kobayashi

[11] 4,220,128

[45] Sep. 2, 1980

[54] DISTRIBUTION TYPE FUEL INJECTION PUMP

[75] Inventor: Masayoshi Kobayashi, Kawagoe, Japan

[73] Assignee: Diesel Kiki Co., Ltd., Tokyo, Japan

[21] Appl. No.: 920,393

[22] Filed: Jun. 29, 1978

[30] Foreign Application Priority Data

Jun. 30, 1977 [JP] Japan ..... 52-77176

[51] Int. Cl.[2] ..... F02M 39/00

[52] U.S. Cl. ..... 123/366; 123/507; 123/139 AQ; 123/503

[58] Field of Search ..... 123/139 ST, 139 AP, 123/139 AQ, 139 BD, 139 AE, 139 AB, 179 L, 179 G, 140 R

[56] References Cited

U.S. PATENT DOCUMENTS

| | | | |
|---|---|---|---|
| 2,159,177 | 5/1939 | Ricardo | 123/129 AP |
| 2,624,327 | 1/1953 | Hogeman | 123/139 BD |
| 2,640,419 | 6/1953 | Evans | 123/139 BD |
| 3,673,996 | 7/1972 | Drein | 123/139 AB |
| 3,910,724 | 8/1975 | Okamoto | 123/138 AQ |
| 3,942,498 | 3/1976 | Eheim | 123/140 R |

FOREIGN PATENT DOCUMENTS

| | | | |
|---|---|---|---|
| 2,649,893 | 5/1978 | Fed. Rep. of Germany | 123/139 ST |

*Primary Examiner*—Charles J. Myhre
*Assistant Examiner*—Carl Stuart Miller
*Attorney, Agent, or Firm*—Birch, Stewart, Kolasch & Birch

[57] ABSTRACT

A distribution type fuel injection pump comprising a plunger and a control sleeve slidably mounted on the plunger. The plunger reciprocally moves along its axis while at the same time rotating about same. The control sleeve is rotated about the plunger at the time of the starting operation of an engine. A groove is formed on the cylindrical inner wall of the control sleeve. A plurality of radial passages connected to the compression chamber of the plunger is formed in the plunger. Each of the radial passages is arranged so as to face the groove of the control sleeve at one time per one revolution of the plunger. At the time of starting the engine, the radial passages are connected to the groove of the control sleeve in the suction stroke for increasing the quantity of the fuel to be injected. Contrary to this, the radial passages are connected to the groove of the control sleeve at the beginning of the delivery stroke slightly after the engine has been started.

6 Claims, 3 Drawing Figures

DISTRIBUTION TYPE FUEL INJECTION PUMP

DESCRIPTION OF THE INVENTION

Background of the Invention

The present invention relates to a distribution type fuel injection pump for use in an internal combustion engine.

In a fuel injection type internal combustion engine such as a diesel engine, in order to easily start an engine, it is necessary to advance the injection timing and increase the quantity of fuel injected into the cylinder of an engine at the time of the starting operation of the engine. The engine of this type is normally equipped with a fuel injection timing control device for advancing the injection timing in accordance with increase in the number of revolutions of the engine. However, such fuel injection timing control device does not have a function to cause the advancing operation of the injection timing necessary to obtain an easy starting operation of an engine. Consequently, in order to appropriately advance the injection timing at the time of the engine starting operation, a conventional engine is provided with a manual fuel injection timing advance device and thus, in a conventional engine, a problem arises in that it is necessary to manually advance the injection timing at the time of the engine starting operation.

SUMMARY OF THE INVENTION

An object of the present invention is to provide a distribution type fuel injection pump capable of automatically advancing the injection timing as well as increasing the quantity of fuel to be injected at the time of the engine starting operation.

According to the present invention, there is provided a fuel injection pump for use in a fuel injection internal combustion engine, comprising: a housing having a fuel chamber therein; a plunger movably mounted on the housing and forming a compression chamber over a head of the plunger; driving means for causing the plunger to reciprocally move along an axis of the plunger and at the same time rotate about the axis of same; fuel supply means for introducing fuel into the compression chamber at the suction stroke; delivery port means for feeding fuel into the engine from the compression chamber at the delivery stroke; a leak port formed in the plunger and connected to the compression chamber; a control sleeve movably mounted on the plunger for normally closing the leak port and for connecting the leak port with the fuel chamber at the end of the delivery stroke to complete the delivery stroke; a governor device actuating the control sleeve for controlling the quantity of fuel to be injected; at least one first passage formed in the control sleeve and connected to the fuel chamber; at least one second passage formed in the plunger and connected to the compression chamber, the second passage being arranged so as to be movably connectable to the first passage at one time per one revolution of the plunger at the beginning of the delivery stroke, and actuating means for rotating the control sleeve about the plunger in order to connect the first passage to the second passage in the suction stroke and disconnect the first passage from the second passage in the delivery stroke at the time of the engine starting operation.

The present invention may be more fully understood from the following description of a preferred embodiment of the invention together with the accompanying drawings.

DESCRIPTION OF A PREFERRED EMBODIMENT

Figure 1:
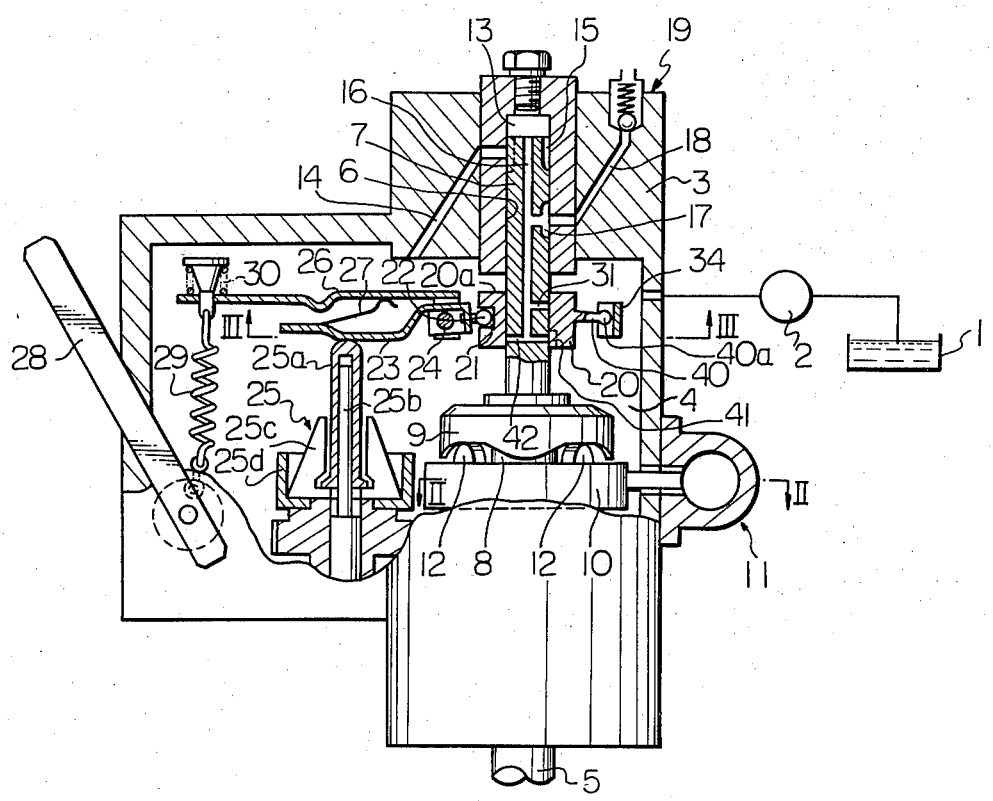
FIG. 1 is a cross-sectional side view of a fuel injection pump according to the present invention.
Figure 2:
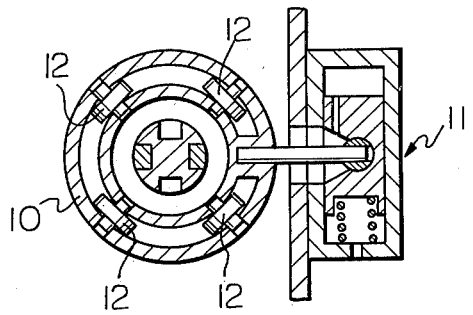
FIG. 2 is a cross-sectional view taken along the line II—II in FIG. 1.

Referring to FIG. 1, fuel is sucked from a fuel tank 1 by means of a fuel pump 2 and then fed into a fuel chamber 4 formed in a pump housing 3. As is known to those skilled in the art, since the delivery pressure of the fuel pump 2 is increased in accordance with increase in the number of revolutions of an engine, i.e. the engine speed, the pressure in the fuel chamber 4 is increased in accordance with the increase in engine speed.

A pump plunger 7 is movably inserted into a barrel 6 formed in the pump housing 3 and, as is hereinafter described, this pump plunger 7 is rotated about its axis and at the same time, reciprocally moved up and down. In FIG. 1, reference numeral 5 designates a drive shaft which is driven by an engine, and the lower end 8 of the plunger 7 is engaged with the upper end of the drive shaft 5 so that the plunger 7 rotates together with the drive shaft 5 and, in addition, the plunger 7 moves up and down relative to the drive shaft 5. A cam disc 9 is fixed onto the plunger 7 and thus, the cam disc 9 rotates together with the plunger 7. This cam disc 9 has, on its lower end, a circular cam face which forms a plurality of peaks. In this embodiment, the number of peaks corresponds to that of the engine combustion chambers. A roller holder 10 is arranged beneath the cam disc 9 in the fuel chamber 4 and rotated by means of a piston-cylinder mechanism 11 (FIG. 3), which serves to advance the injection timing in accordance with increase in the pressure within the fuel chamber 4, that is, in the engine speed. The roller holder 10 has a plurality of rollers 12 which are always in contact with the circular cam face of the cam disc 9 so as to cause the plunger 7 to move upwards when the peaks of the circular cam face of the cam disc 9 move on the rollers 12. Consequently, when the drive shaft 5 is driven, the plunger 7 reciprocally moves up and down while rotating about its axis.

At the time of the suction stroke of the plunger 7, that is, when the plunger 7 moves downwards (in FIG. 1), fuel is fed into a plunger chamber 13 of the barrel from the fuel chamber 4 via a fuel feed port 14 formed in the pump housing 3 and via one of a plurality of longitudinal grooves 15 formed on the outer periphery of the top of the plunger 7. On the other hand, in the delivery stroke of the plunger 7, the longitudinal groove 15 is disconnected from the fuel feed port 14 immediately after the upward movement of the plunger 7 is started. When the plunger 7 further moves upwards, the fuel in the plunger chamber 13 is fed into one of the distribution ports 18 via a central bore 16 and a transverse bore 17 and then fed into the fuel injector (not shown) via a check valve 19. Thus, the injection operation is carried out.

As illustrated in FIG. 1, a control sleeve 20 is slidably mounted on the plunger 7. As is shown by the broken line in FIG. 3, a circumferential groove 21 is formed on the outer peripheral surface of the control sleeve 20, and one end 22 of a lever 23 which is pivotably mounted on the pivot pin 24 is fitted into the circumferential groove 21. The other end of the lever 23 is arranged to always engage with a centrifugal governor 25 so that the lever 23 is actuated by the centrifugal governor 25. The centrifugal governor 25 is a known type of engine speed governor as illustrated below.

The lever 23 faces the operation end of a centrifugal governor sleeve 25*a* and this sleeve 25*a* is moved in the axial direction on a sliding shaft 25*b* by a fly-weight 25*c*. The fly-weight 25*c* is mounted on a pocket member 25*d* which is driven by the engine. Accordingly, the fly-weight 25*c* is moved outwardly in the radial direction based on the centrifugal force in correspondence to the engine speed by the pocket member 25*d* and then the centrifugal force is transmitted to the lever 23 so as to shift the lever 23 upwardly. Namely, with increase of the engine speed, the lever 23 is turned around the pin 24 in the clockwise direction in FIG. 1 to bring down the control sleeve 20. In addition, one end of a tension lever 26 is pivotably mounted on the pivot pin 24, and the lever 23 is resiliently engaged with the tension lever 26 via a start spring 27. Furthermore, a control lever 28 which is connected to the acceleration pedal (not shown) is connected to one end of the tension lever 26 via a main spring 29 and an idle spring 30.

FIG. 1 shows the moment when an engine is started. At this time, as is illustrated in FIG. 1, the control sleeve 20 is positioned at its uppermost position. Once an engine is started, the speed of an engine is gradually increased and then, an engine is operated under an idling condition slightly after an engine is started. At this time, the control sleeve 20 moves downwards to a slight extent from its uppermost position shown in FIG. 1 due to the upward movement of the centrifugal governor 25. As is illustrated in FIG. 1, another transverse bore 31 which is in communication with the central bore 16 is formed in the middle portion of the plunger 7 so that the other transverse bore 31 is closed by the cylindrical inner wall of the control sleeve 21 when the plunger 7 is positioned at its lower position. As mentioned above, fuel in the plunger chamber 13 is gradually fed into the distribution port 18 as the plunger 7 moves upwards. When the plunger 7 approaches its uppermost position, the transverse bore 31 moves upwards beyond the upper surface 20*a* of the control sleeve 20 and opens into the fuel chamber 4. At this time, the fuel under pressure in the plunger chamber 13 is discharged into the fuel chamber 4 via the center bore 16 and the transverse bore 31 and as a result, the injecting operation of fuel is terminated. As mentioned above, the control sleeve 20 is positioned at its uppermost position at the moment when an engine is started. In addition, the control sleeve 20 moves downwards as the number of engine revolutions is increased. Consequently, from FIG. 1, it will be understood that, as the number of engine revolutions is increased, the terminal moment of the fuel injection is advanced, that is, the quantity of the fuel injected into the cylinders of an engine is reduced.

Figure 3:
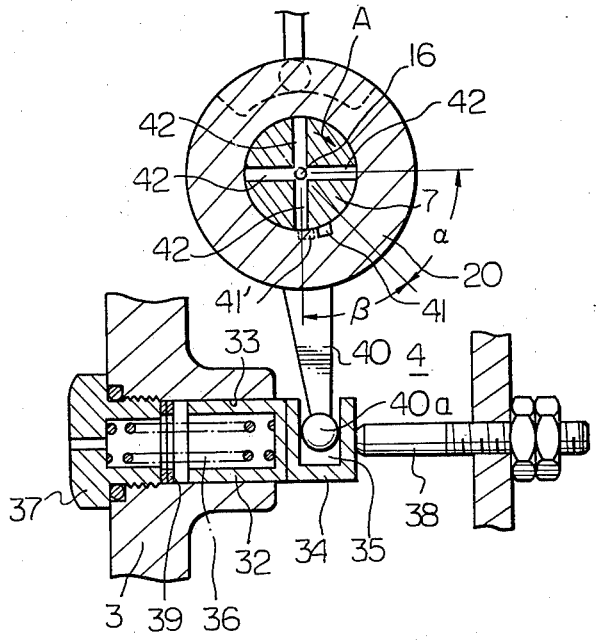
FIG. 3 is a cross-sectional view taken along the line III—III in FIG. 1.

Referring to FIG. 3, a piston 32 is inserted into a cylinder bore 33 formed in the pump housing 3, and a channel member 34 having a groove 35 is fixed onto the top face of the piston 32. As is apparent from FIG. 3, the piston 32 is so arranged that the groove 35 of the channel member 34 is always exposed to the fuel chamber 4. In addition, a compression spring 36 is inserted between the piston 32 and a bolt 37 which is screwed into the cylindrical more 33. Consequently, the piston 32 is caused to move in accordance with the difference between the spring force of the compression spring 36 and the pressure acting on the top face of the piston 32. That is, since the pressure in the fuel chamber 4 is low immediately after an engine is started, the piston 32 projects from the cylinder bore 33 by the spring force of the compression spring 36 and abuts against a stop 38 as illustrated in FIG. 3.

On the other hand, when the pressure in the fuel chamber 4 is increased slightly after the engine is started, the piston 32 is retracted against the spring force of the compression spring 36 until the piston 32 abuts against the bolt 37 via spacers 39 used for adjusting the stroke of the piston 32.

As illustrated in FIGS. 1 and 3, a projecting arm 40 is formed on the outer peripheral wall of the control sleeve 20, and the spherical head 40*a* of the arm 40 is fitted into the groove 35 of the channel member 34. Consequently, the movement of the piston 32 causes the control sleeve 20 to rotate around the plunger 7. In addition, a single groove 41 is formed on the lower end of the cylindrical inner wall of the control sleeve 20, and a plurality of radial passages 42 which are in communication with the central bore 16 is formed in the plunger 7 at the same level as the groove 41. These radial passages 42 are so arranged, that they do not directly open into the fuel chamber 4 independent of the position of the control sleeve 20. In addition, the groove 41 has such a height that each of the radial passages 42 faces the groove 41 at one time per one revolution of the plunger 7.

FIGS. 1 and 3 show the case wherein the plunger 7 is positioned at its lowermost position. Consequently, in FIG. 3, the delivery operation of the fuel is carried out during the time the plunger 7 rotates in the direction shown by the arrow A by an angle $\alpha$, and the sucking operation of the fuel is carried out during the time the plunger 7 further rotates in the direction A by an angle $\beta$. As mentioned previously, at the moment when an engine is started, the plunger 7 abuts against the stop 38 as illustrated in FIG. 3. At this time, the groove 41 is positioned at a position shown in FIG. 3. Consequently, any one of the radial passages 42 does not face the groove 41 during the delivery stroke and thus, the fuel in the cylinder room 13 does not leak into the fuel chamber 4 during the delivery stroke. On the other hand, as it will be understood from FIG. 3, one of the radial passages 42 faces the groove 41 at the latter half of the suction stroke.

As mentioned previously, the pressure in the fuel chamber 4 is increased just slightly after an engine is started. Consequently, the piston 32 is retracted against the spring force of the compression spring 36 and abuts against the spacer 39. As a result of this, the control sleeve 20 is rotated in the clockwise direction and accordingly, the groove 41 moves to the position shown by the broken line 41′ in FIG. 3. As a result of this, as will be understood from FIG. 3, one of the radial passages 42 faces the groove 41′ at the beginning of the delivery stroke. At this time, since a part of the fuel in the cylinder room 13 escapes into the fuel chamber 4 via the radial passage 42 and the groove 41, the fuel is not fed into the fuel injector via the check valve 19. The fuel is fed into the fuel injector when the plunger 7 further moves upwards and then, the radial passage 42 is disconnected from the groove 41. Consequently, when an engine is operated under normal operating conditions, the start timing of the fuel injection is retarded by a length of time during which one of the radial passages 42 faces the groove 41 at the beginning of the delivery stroke, as compared with the case wherein the starting operation of an engine is carried out.

Consequently, at the time of the starting operation of an engine, the amount of fuel injected into the cylinders of an engine is increased as compared with the case wherein an engine is operated under normal operating conditions. The length of time during which one of the radial passages 42 faces the groove 41 can be easily adjusted by exchanging the spacer 39 for another spacer having a different thickness.

In the embodiment shown in FIGS. 1 and 3, a conventional control sleeve is utilized for advancing the injection timing at the time of the starting operation of an engine. However, in addition to a conventional control sleeve, another control sleeve is mounted on the plunger for advancing the injection timing at the engine starting operation.

According to the present invention, at the time of the engine starting operation, the start timing of the fuel injection can be automatically advanced by using a fuel pump having a simple construction. As a result of this, the starting operation of a fuel injection type engine such as a Diesel engine can be easily carried out. In addition, since the injection timing is automatically advanced, there is an advantage in that it is not necessary to manually advance the injection timing as in conventional fuel pumps.

What is claimed is:

1. A fuel injection pump for use in a fuel injected internal combustion engine having a fuel feed pump, said fuel injection pump comprising:

a housing having a fuel chamber contained therein, said fuel chamber being supplied with fuel by said fuel feed pump and being pressurized to the output pressure of said fuel feed pump;

a plunger having a longitudinal axis of movement, said plunger being movably mounted and forming a compression chamber within said housing at one end portion of said plunger, said plunger having a delivery stroke and a suction stroke;

driving means for reciprocally moving said plunger along said axis and for rotating said plunger about said axis;

fuel supply means for introducing fuel into said compression chamber during said suction stroke;

delivery port means for feeding fuel into the engine from said compression chamber during said delivery stroke;

a leak port formed in said plunger and connected to said compression chamber;

a control sleeve movably mounted on said plunger for normally closing said leak port and for connecting said leak port to said fuel chamber at the end of said delivery stroke to complete said delivery stroke;

a governor device actuating said control sleeve for controlling the quantity of fuel to be injected;

a first passage formed in said control sleeve and connected to said fuel chamber;

a second passage formed in said plunger and connected to said compression chamber, said second passage being arranged for normal connection with said first passage once per one stroke of said plunger at the beginning of said delivery stroke; and actuating means for rotating said control sleeve about said plunger to connect said first passage to second passage during said suction stroke and to disconnect said first passage from said second passage during said delivery stroke during the starting operation of said internal combustion engine, said actuating means being responsive to the output pressure of said fuel feed pump to sense the completion of the starting operation and thereby connect said first passage to said second passage during said delivery stroke.

2. A fuel injection pump as claimed in claim 1, wherein said second passage comprises a plurality of radial bores.

3. A full injection pump as claimed in claim 1, wherein said actuating means includes, a piston having a top face exposed to the pressure within said fuel chamber, and bias means for applying a bias force to said piston in a direction opposite to the force applied by the fuel chamber pressure, said piston moving in accordance with the difference between said bias force and the fuel chamber pressure.

4. A fuel injection pump as claimed in claim 3, wherein said control sleeve has an arm attached thereto, and wherein said piston includes a channel member having a groove, said arm engaging with said groove of said channel member.

5. A fuel injection pump as claimed in claim 3, wherein said control sleeve has a cylindrical inner wall which is sealingly inserted around said plunger, said first passage being formed between said plunger and said cylindrical inner wall of said control sleeve.

6. A fuel injection pump as claimed in claim 5, wherein said first passage is a groove formed on one end portion of said cylindrical inner wall of said control sleeve.

* * * * *